US008919326B2

(12) United States Patent
Lim et al.

(10) Patent No.: US 8,919,326 B2
(45) Date of Patent: Dec. 30, 2014

(54) FUEL PUMP MODULE

(75) Inventors: Jong Keun Lim, Cheongju-si (KR); In Seok Sohn, Cheongju-si (KR); Ohk Sung Kim, Jeollanam-do (KR); Joon Seup Kim, Daejeon (KR)

(73) Assignee: Coavis, Chungcheongnam-do (KR)

( * ) Notice: Subject to any disclaimer, the term of this patent is extended or adjusted under 35 U.S.C. 154(b) by 487 days.

(21) Appl. No.: 12/987,621

(22) Filed: Jan. 10, 2011

(65) Prior Publication Data

US 2011/0168134 A1 Jul. 14, 2011

(30) Foreign Application Priority Data

Jan. 12, 2010 (KR) ..... 10-2010-0002575

(51) Int. Cl.
*F02M 37/08* (2006.01)
*F02M 37/10* (2006.01)

(52) U.S. Cl.
CPC ..... *F02M 37/106* (2013.01); *F02M 37/103* (2013.01)
USPC ..... 123/509; 137/565.22; 210/416.4

(58) Field of Classification Search
CPC .. B01D 35/027; B01D 35/26; B01D 35/0276; F02M 2037/225; F02M 2037/228
USPC ..... 123/509, 195 A, 195 C, 198 C, 198 E
See application file for complete search history.

(56) References Cited

U.S. PATENT DOCUMENTS

| | | | | | |
|---|---|---|---|---|---|
| 1,395,469 | A * | 11/1921 | Benbow | 137/625.69 |
| 1,609,964 | A * | 12/1926 | Roby | 137/382 |
| 2,212,343 | A * | 8/1940 | Goehring | 137/625.4 |
| 3,591,004 | A * | 7/1971 | Roosa | 210/94 |
| 3,630,382 | A * | 12/1971 | Hodgkins | 210/443 |
| 3,633,756 | A * | 1/1972 | Buckman | 210/443 |
| 5,649,514 | A * | 7/1997 | Okada et al. | 123/514 |
| 6,712,590 | B1 * | 3/2004 | Villela et al. | 417/423.9 |
| 6,923,208 | B2 * | 8/2005 | Okabe et al. | 137/565.22 |
| 2004/0000516 | A1 * | 1/2004 | Okabe et al. | 210/416.4 |
| 2006/0070941 | A1 * | 4/2006 | Cline et al. | 210/416.4 |
| 2011/0204625 | A1 * | 8/2011 | Cho et al. | 285/405 |

* cited by examiner

*Primary Examiner* — Hai Huynh
*Assistant Examiner* — Gonzalo Laguarda
(74) *Attorney, Agent, or Firm* — The Webb Law Firm

(57) ABSTRACT

A fuel pump module, in which an in-tank filter and a fuel pump are installed at respective locations and held by a pump retainer, thereby allowing fuel to easily flow in the fuel pump module and realizing smallness and improved filtering performance of the fuel pump module.

6 Claims, 14 Drawing Sheets

PRIOR ART

PRIOR ART

PRIOR ART

FUEL PUMP MODULE

BACKGROUND OF THE INVENTION

1. Field of the Invention

The present invention relates, in general, to a fuel pump module and, more particularly, to a fuel pump module, in which an in-tank filter and a fuel pump are installed at respective locations and held by a pump retainer, thereby allowing fuel to easily flow in the fuel pump module and realizing smallness and improved filtering performance of the fuel pump module.

2. Description of the Related Art

Generally, a vehicle operated by an internal combustion engine using liquid fuel, such as a gasoline engine or a diesel engine, is provided with a fuel tank for storing fuel. In the vehicle, a fuel pump module is installed in the fuel tank to forcibly feed the fuel stored in the fuel tank to the internal combustion engine.

Foreign substances present in the fuel may have bad effects on the atmospheric air, so that, in an effort to remove the foreign substances from the fuel before the fuel reaches the internal combustion engine, a filter is provided in a fuel supply line at a location inside or outside the fuel pump module.

In recent years, there has been an increasing interest in the environment, the restriction of vehicle exhaust gases is becoming strict, and a filter-embedded fuel pump module having improved filtering performance is attracting attention.

An example of conventional filter-embedded fuel pump modules is shown in FIGS. 1 through 3.

As shown in FIGS. 1 through 3, the fuel pump module 1 comprises a flange assembly 10 mounted to a fuel tank and a reservoir body assembly 20 connected to the flange assembly 10 by guide rods 30 at a location below the flange assembly 10.

The reservoir body assembly 20 includes a reservoir casing 21, a fuel pump 23 installed in the reservoir casing 21 and pumping the fuel stored in a fuel tank into the reservoir casing 21, and an in-tank filter 22 installed in the reservoir casing 21 and filtering the inlet fuel pumped by the fuel pump. The top end of the in-tank filter 22 is connected to the flange assembly 10 by a connection hose 40 and feeds the filtered fuel to the flange assembly 10 which supplies the filtered fuel to an internal combustion engine.

Here, in the reservoir body assembly 20, the fuel pump 23 is placed in the center of the assembly 20 and the in-tank filter 22 surrounds the fuel pump 23.

Described in detail, the in-tank filter 22 comprises: an upper casing 25, which is assembled with the reservoir casing 21 and thereby closes the top of the reservoir body assembly 20 and is hollowed to define a space therein for receiving the fuel pump 23 in the space, and is open in the lower end thereof so as to surround the fuel pump 23 and to receive a filtering sheet 24 therein through the open lower end; and a lower casing 26 which closes the lower part of the upper casing 25 except for the space receiving the fuel pump 23, wherein the upper casing 25 is provided with a fuel inlet part 27, which is connected to the fuel pump 23 for receiving the fuel pumped by the fuel pump 23, and a fuel discharging port 28 which is connected to the connection hose 40 and discharges the fuel that passed through the in-tank filter 22 so as to supply the fuel to the internal combustion engine.

However, in the fuel pump module 1, the fuel pump 23 and the in-tank filter 22 are provided in the inside and outside parts and have respective diameters larger than predetermined diameters, respectively, thus increasing the size of the fuel pump module. Thus, it is not easy to mount the large-sized fuel pump module 1 to the fuel tank.

In the fuel pump module 1, the fuel will flow as follows. As shown in FIG. 3, the fuel introduced into the fuel pump 23 flows through the fuel inlet part 27 of the in-tank filter 22 and is filtered by the filtering sheet. The fuel filtered by the filter sheet is supplied to the internal combustion engine sequentially through the fuel discharging port 28, the connection hose 40, the flange assembly 10 and a fuel supply line.

However, in the fuel pump module 1, the fuel discharging port 28 of the in-tank filter 22 is provided in a region in which the filtering sheet 24 is vertically installed, so that the fuel pump module 1 is problematic in that the fuel cannot be easily supplied to the engine.

Further, as time goes by, the filtering performance of the filtering sheet of the in-tank filter 22 deteriorates and the in-tank filter must be replaced by a new one, so that it is required to provide an improved design of a fuel pump module which can realize improved filtering performance and can increase the life span of the in-tank filter 22.

SUMMARY OF THE INVENTION

Accordingly, the present invention has been made keeping in mind the above problems occurring in the related art, and the present invention is intended to propose a fuel pump module, in which an in-tank filter and a fuel pump are installed in a reservoir casing in such a way that the fuel pump module can realize smallness and improved filtering performance.

Further, the present invention is intended to propose a fuel pump module, in which the fuel pump is mounted at a location outside the in-tank filter and a fuel discharging port is formed in the center inside a filtering sheet, so that the fuel pump module can have further improved filtering performance and can allow the fuel to easily flow therein, and has improved sealing performance.

Further, the present invention is intended to propose a fuel pump module, in which the fuel discharging port of the in-tank filter branches in opposite directions, so that one end of the branched fuel discharging port can be connected to the connection hose while the other end can be closed, thus realizing a simple process of assembling the fuel pump module.

In order to achieve the above objects, according to one aspect of the present invention, there is provided a fuel pump module, comprising: a flange assembly mounted to a fuel tank and having a fuel outlet port for supplying fuel to an internal combustion engine; a reservoir body assembly connected to the flange assembly at a location below the flange assembly, the reservoir body assembly including: a reservoir casing; a fuel pump installed in the reservoir casing and pumping the fuel into the reservoir casing and provided at a predetermined location with a fuel feeding port for feeding the pumped fuel; an in-tank filter including a fuel inlet part connected to the fuel feeding port of the fuel pump, a filtering sheet for filtering the fuel fed from the fuel pump, and a fuel discharging port connected to the fuel outlet port of the flange assembly by a connection hose and supplying the filtered fuel to the flange assembly; and a pump retainer for holding both the fuel pump and the in-tank filter and closing an upper end of the reservoir casing.

In the fuel pump module, the in-tank filter may include: an upper casing having an open lower end and receiving the filtering sheet therein, with the fuel inlet part being formed on a predetermined position of an outer circumferential surface of the upper casing and being connected to the fuel feeding port of the fuel pump and with the fuel discharging port being formed on an upper end of the upper casing; and a lower casing closing the open lower end of the upper casing.

Further, the fuel inlet part may protrude from the predetermined position of the upper casing in such a way that the fuel feeding port of the fuel pump can be inserted upwards into the fuel inlet part.

The fuel pump module may further comprise: a sealing member provided in a junction between the fuel inlet part of the in-tank filter and the fuel feeding port of the fuel pump.

Further, the in-tank filter may be provided on the lower casing with a fuel return part for discharging the filtered fuel into the reservoir casing.

Further, in the in-tank filter, the filtering sheet may be folded several times to form a folded cylindrical shape, and both the fuel discharging port and the fuel return part may be concentric with a central axis of the in-tank filter so as to communicate with an interior of the cylindrical filtering sheet.

Further, the fuel discharging port of the in-tank filter may branch in opposite directions.

Further, the pump retainer may be provided with a first seat and a second seat for seating the in-tank filter and the fuel pump therein, respectively.

Further, the in-tank filter may be provided with a first locking protrusion protruding on the outer circumferential surface of an upper casing of the in-tank filter in such a way that thickness of the first locking protrusion becomes thinner in an upward direction so as to be gradually reduced in the upward direction, and the pump retainer may be provided with a first locking hole formed in the first seat for catching the first locking protrusion, thus holding the in-tank filter in the pump retainer.

Further, the in-tank filter may be provided with a guide rail axially formed on the outer circumferential surface of the upper casing, and the pump retainer may be provided with a guide flange having a shape corresponding to that of the guide rail and being formed on the inner circumferential surface of the first seat, and guiding axial movement of the guide rail in the first seat.

The fuel pump module may further comprise: a primary filter assembly provided at a location outside the fuel pump, the primary filter assembly comprising a primary filter for filtering primarily sucked fuel and a filter holding unit for holding the primary filter.

Further, the second seat of the pump retainer may be configured to surround an outer circumferential surface of the fuel pump, with a second locking protrusion protruding from an outer circumferential surface of the second seat in such a way that the second locking protrusion becomes thinner in a downward direction so as to gradually reduce in thickness thereof in the downward direction, and with a second locking hole formed in the filter holding unit of the primary filter assembly for catching the second locking protrusion, so that the primary filter assembly can be locked in the pump retainer.

As described above, the fuel pump module according to the present invention is advantageous in that, in the fuel pump module, the in-tank filter and the fuel pump are installed in the reservoir casing at respective locations, thus realizing improved filtering performance and smallness, and thereby realizing a simple process of producing the fuel pump module and reducing the production cost of the fuel pump module.

Further, in the fuel pump module of the present invention, the fuel pump is mounted outside the in-tank filter and the fuel discharging port is formed in the center inside the filtering sheet, so that the fuel pump module can have an increasingly improved filtering performance and the fuel can easily flow therein, and has improved sealing performance.

Further, in the fuel pump module, the fuel discharging port of the in-tank filter branches in opposite directions, so that one end of the branched fuel discharging port can be connected to the connection hose while the other end can be closed, and thereby a simple process of assembling the fuel pump module can be realized.

BRIEF DESCRIPTION OF THE DRAWINGS

The above and other objects, features and other advantages of the present invention will be more clearly understood from the following detailed description when taken in conjunction with the accompanying drawings, in which.

DESCRIPTION OF THE ELEMENTS IN THE DRAWINGS

| | |
|---|---|
| 10000: fuel pump module | 1100: fuel outlet port |
| 1000: flange assembly | 2000: reservoir body assembly |
| 2100: reservoir casing | 2200: fuel pump |
| 2201: fuel feeding port | 2300: in-tank filter |
| 2310: filtering sheet | 2320: upper casing |
| 2321: fuel inlet part | 2322: fuel discharging port |
| 2323: first locking protrusion | |
| 2324: guide rail | 2330: lower casing |
| 2331: fuel return part | 2400: pump retainer |
| 2410: first seat | 2411: first locking hole |
| 2412: guide flange | 2420: second seat |
| 2421: second locking protrusion | |
| 2500: sealing member | 2600: primary filter assembly |
| 2610: primary filter | 2620: filter holding unit |
| 2621: second locking hole | 2700: pressure regulator |
| 3000: guide rod | 4000: connection hose |

DETAILED DESCRIPTION OF THE INVENTION

Hereinbelow, preferred embodiments of a fuel pump module according to the present invention will be described in detail with reference to the accompanying drawings.

Figure 1:
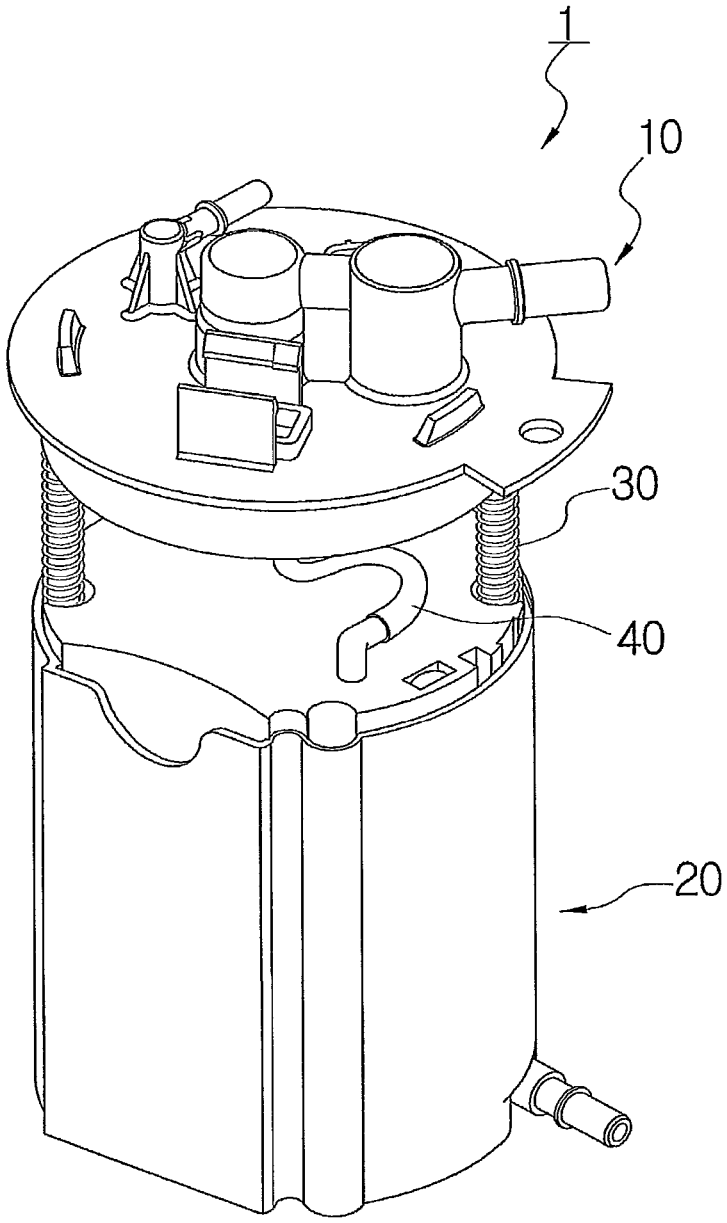
FIGS. 1 through 3 are a perspective view, an exploded perspective view and a sectional view illustrating a conventional fuel pump module.
Figure 2:
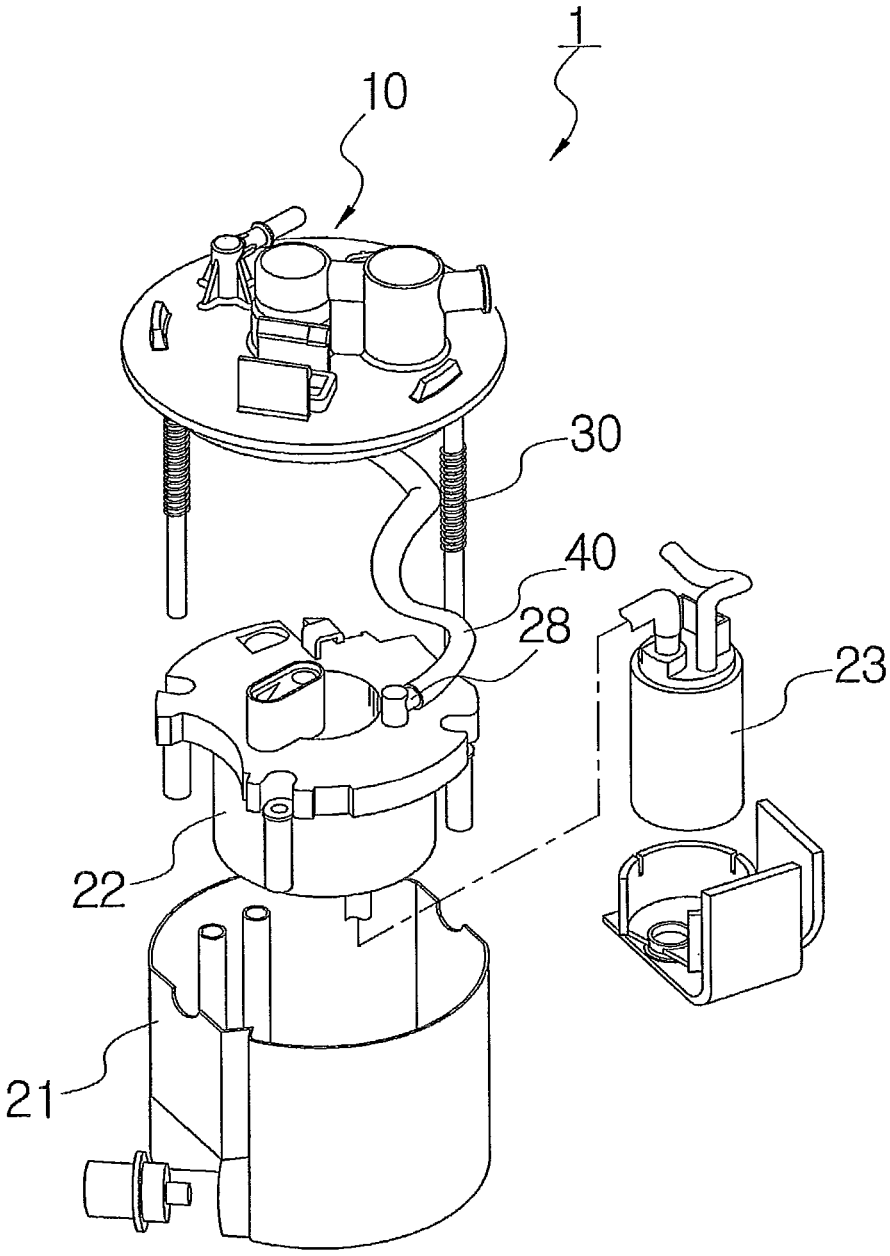
Figure 3:
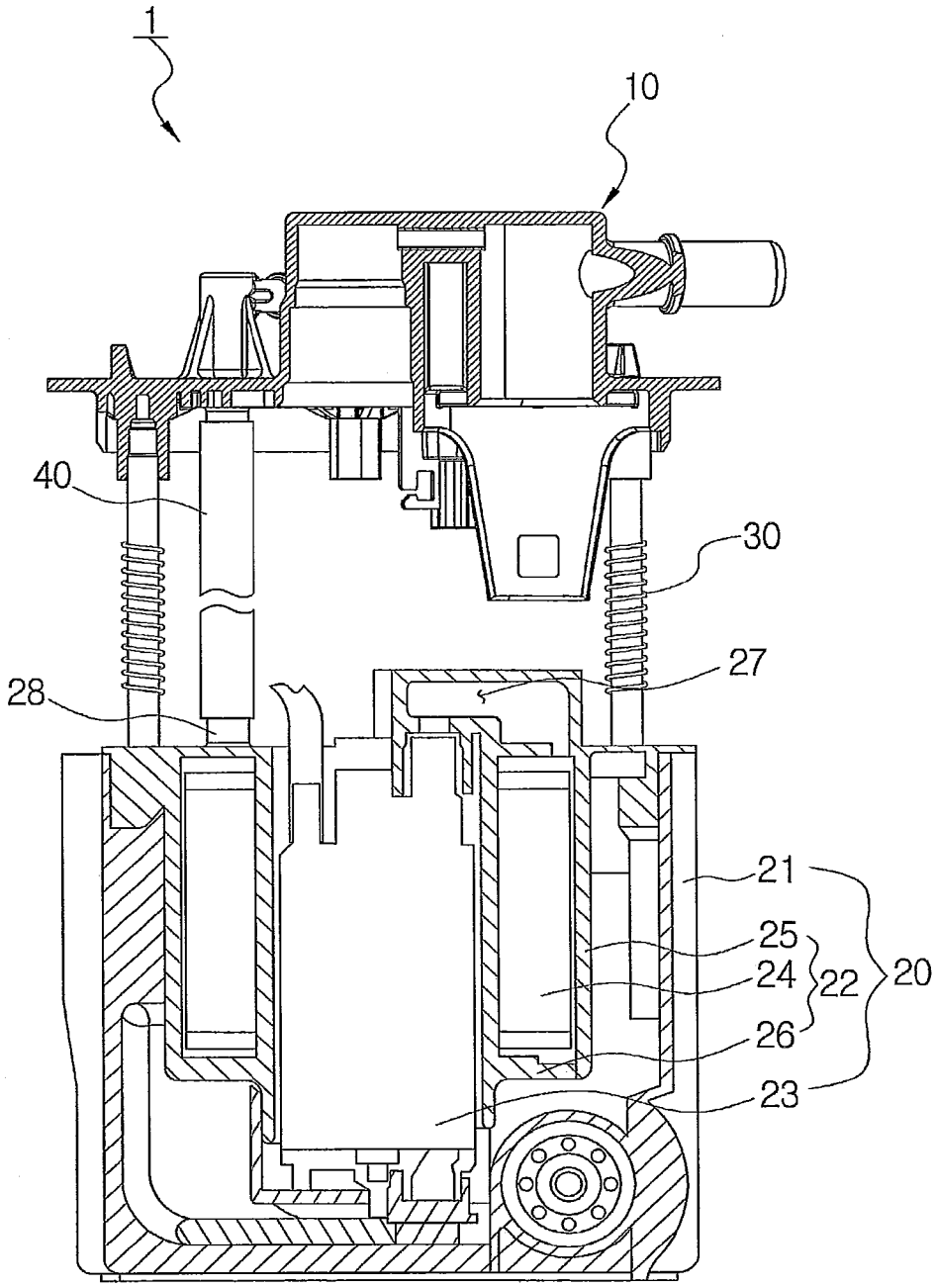
Figure 4:
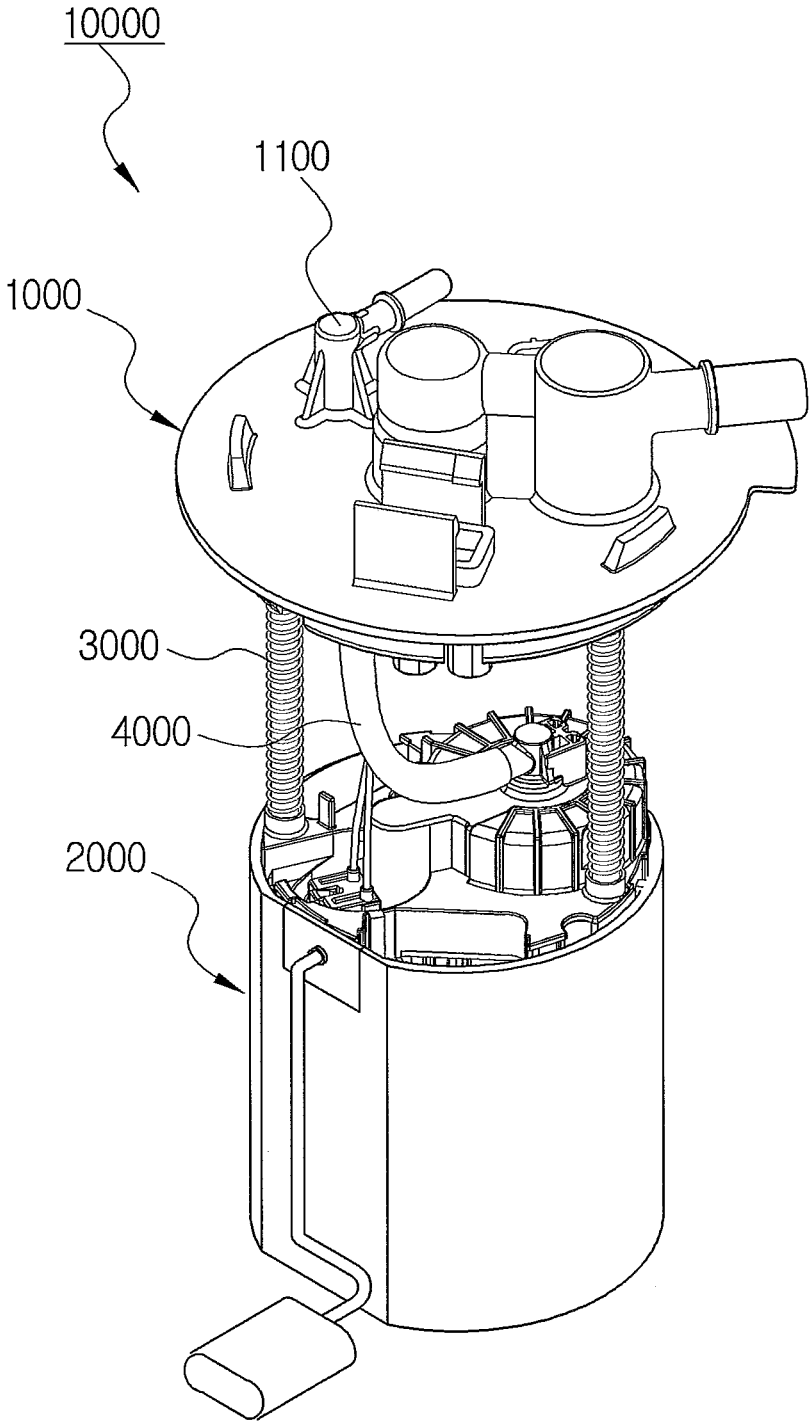
FIGS. 4 and 5 are a perspective view and an exploded perspective view illustrating a fuel pump module according to an embodiment of the present invention.
Figure 5:
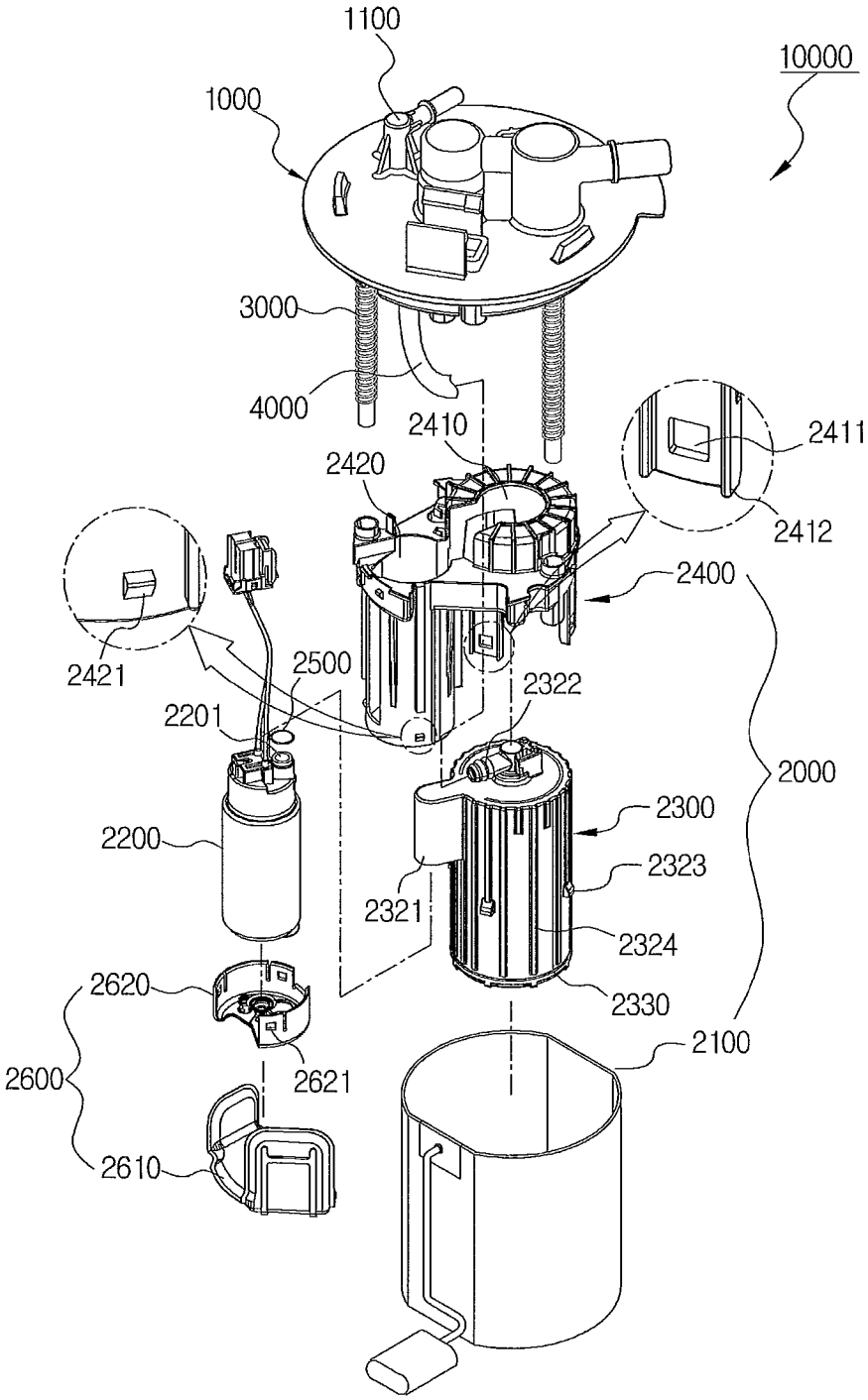
Figure 6:
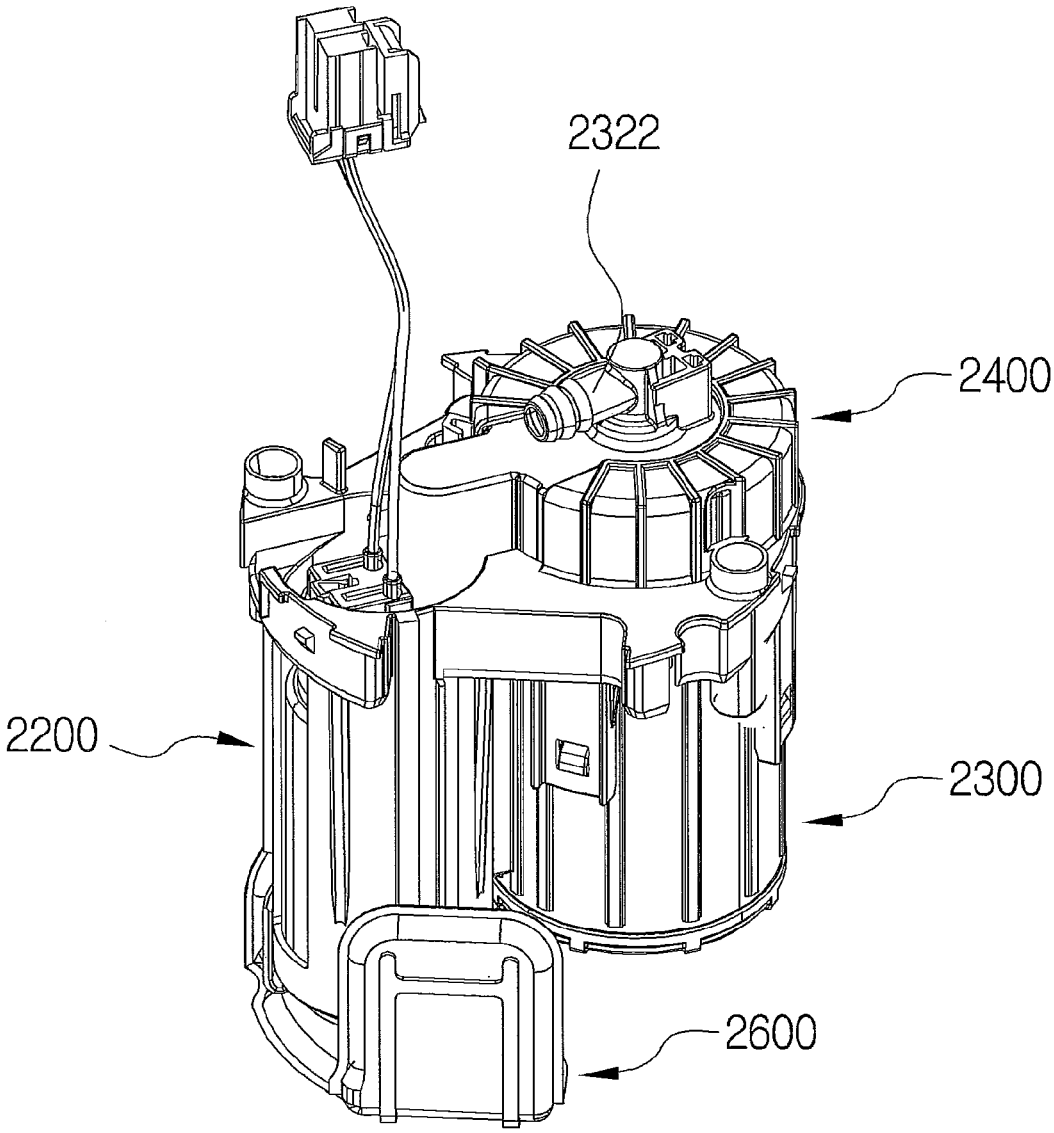
FIG. 6 is a perspective view illustrating the fuel pump module according to the present invention, in which a pump retainer, a fuel pump, an in-tank filter and a primary filter assembly are assembled with each other.
Figure 7:
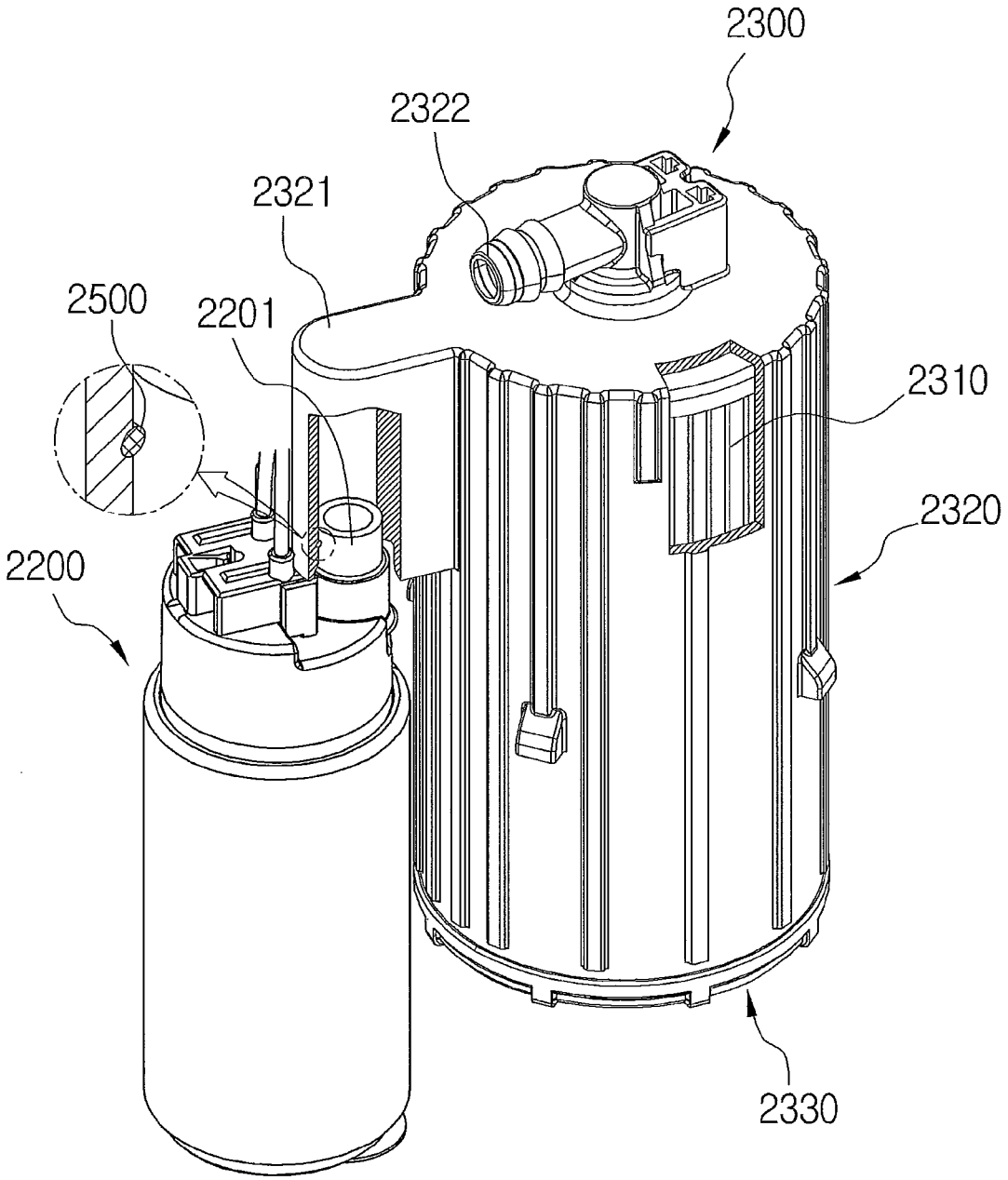
FIGS. 7 and 8 are an assembled perspective view and an exploded perspective view illustrating the fuel pump and the in-tank filter of the fuel pump module according to the present invention.
Figure 8:
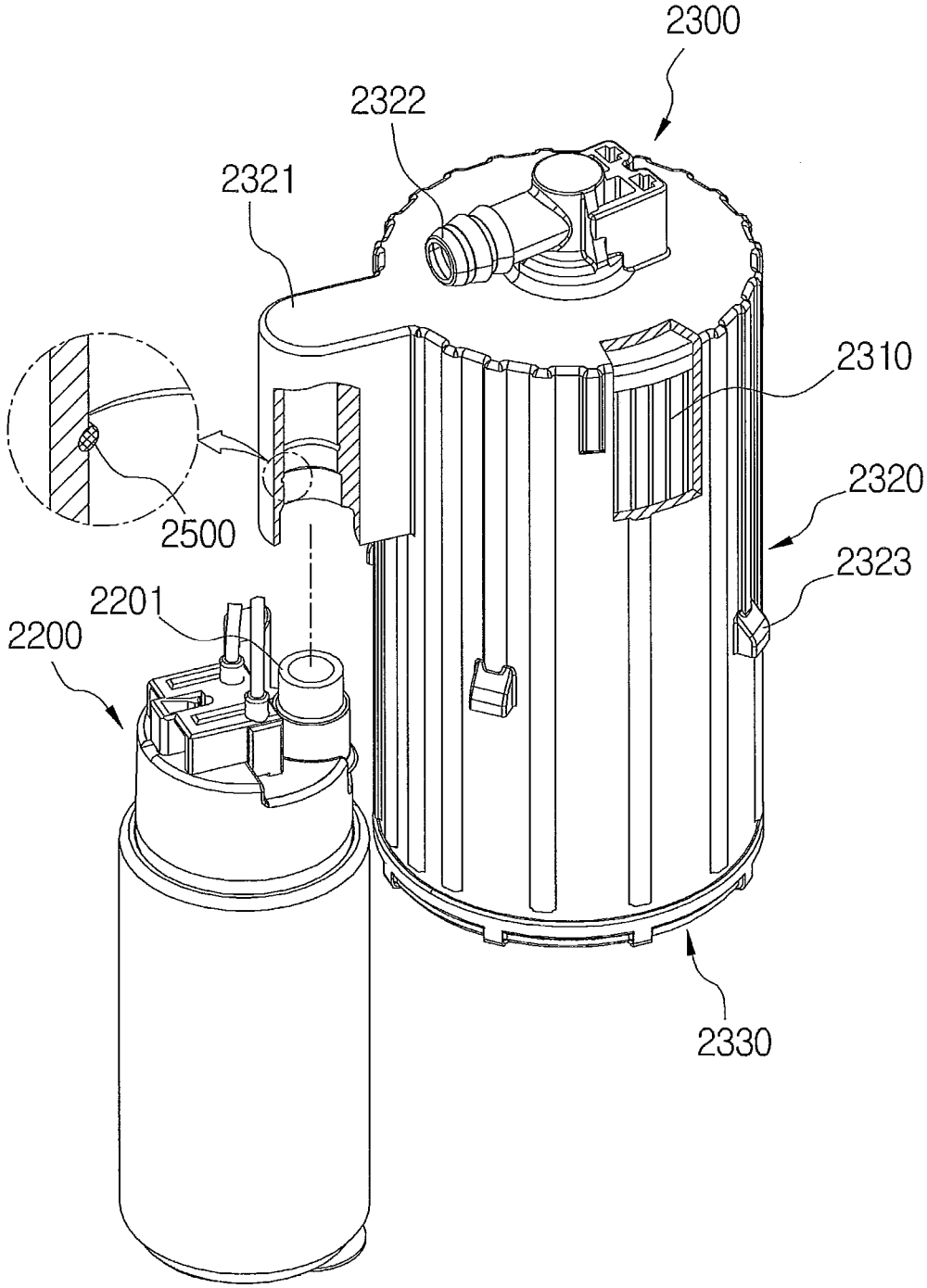

FIGS. 4 and 5 are a perspective view and an exploded perspective view of a fuel pump module 10000 according to the present invention. FIG. 6 is a perspective view illustrating the fuel pump module 10000 according to the present invention, in which a pump retainer 2400, a fuel pump 2200, an in-tank filter 2300 and a primary filter assembly 2600 are assembled with each other. FIGS. 7 and 8 are an assembled perspective view and an exploded perspective view illustrating the fuel pump 2200 and the in-tank filter 2300 of the fuel pump module 10000 according to the present invention.

The fuel pump module 10000 according to the present invention comprises a flange assembly 1000 and a reservoir body assembly 2000 mounted to the flange assembly 1000 at a location below the flange assembly 1000.

The flange assembly 1000 is mounted to a fuel tank and supports the elements of the fuel pump module 10000. The flange assembly 1000 is provided with a fuel outlet port 1100 for feeding fuel, which was pumped from a fuel tank and was filtered, to an internal combustion engine.

The fuel outlet port 1100 protrudes upwards and is connected at the upper end thereof to a fuel supply line which feeds the fuel to the internal combustion engine and is connected at the lower end thereof to a connection line which supplies the fuel to the fuel outlet port 1100 from the reservoir body assembly 2000.

The flange assembly 1000 may be provided with a valve for regulating pressure inside the assembly 1000.

The reservoir body assembly 2000 is mounted to the flange assembly 1000 by guide rods 3000 at a location below the flange assembly 1000, with the fuel pump 2200 being installed in the assembly 2000. The reservoir body assembly 2000 includes the reservoir casing 2100, the fuel pump 2200, the in-tank filter 2300, and the pump retainer 2400.

The reservoir casing 2100 forms the housing of the reservoir body assembly 2000, with a space defined in the reservoir casing 2100 for allowing fuel to be introduced thereto and receiving the elements of the reservoir body assembly 2000 therein. The top end of the reservoir casing 2100 is open.

The fuel pump 2200 is installed in the reservoir casing 2100 and pumps the fuel into the reservoir casing 2100. The fuel pump 2200 is provided at a predetermined location with a fuel feeding port 2201 for feeding the pumped fuel.

The in-tank filter 2300 receives the fuel fed from the fuel pump 2200 and filters the fuel. The in-tank filter 2300 includes a fuel inlet part 2321 connected to the fuel feeding port 2201 of the fuel pump 2200, a filtering sheet 2310 for filtering the fuel fed from the fuel pump 2200, and a fuel discharging port 2322 connected to the fuel outlet port 1100 of the flange assembly 1000 by the connection hose 4000 and supplying the filtered fuel to the flange assembly 1000.

In the fuel pump module of the present invention, the in-tank filter 2300 and the fuel pump 2200 have respective independent constitutions and are installed in the reservoir casing 2100. To allow the in-tank filter 2300 and the fuel pump 2200 to be assembled with each other in such a way that their external surfaces can be in close contact with each other, the fuel inlet part 2321 protrudes from a predetermined position of the in-tank filter 2300 and the fuel feeding port 2201 is formed on the upper end of the fuel pump 2200, so that, when the fuel feeding port 2201 of the fuel pump 2200 is inserted upwards into the fuel inlet part 2321, the fuel pump 2200 can be closely assembled with the in-tank filter 2300.

The in-tank filter 2300 includes an upper casing 2320, a lower casing 2330 and the filtering sheet 2310, in which the upper casing 2320 has both the fuel inlet part 2321 and the fuel discharging port 2322. The lower end of the upper casing 2320 is open and receives the filtering sheet 2310 therein, with the fuel inlet part 2321 being formed on the predetermined position of the upper casing 2320 and with the fuel discharging port 2322 being formed on the upper end of the upper casing 2320.

The lower casing 2330 closes the open lower end of the upper casing 2320 and may include a fuel return part 2331, which can discharge the partially filtered fuel into the reservoir casing 2100 outside the in-tank filter 2300.

In the present invention, it is preferred that the filtering sheet 2310 be folded several times to form a folded cylindrical shape and the upper casing 2320 have a cylindrical shape.

Further, it is preferred that the fuel inlet part 2321 be formed on the outer circumferential surface of the upper casing 2320. Further, it is preferred that the fuel discharging port 2322 and the fuel return part 2331 be formed on the upper end of upper casing 2320 and on the lower end of the lower casing 2330 in such a way that the fuel discharging port 2322 and the fuel return part 2331 are concentric with the central axes of the upper casing 2320 and the lower casing 2330, respectively, and can communicate with the interior of the cylindrical filtering sheet 2310.

In the present invention, the fuel pump module 10000 is configured such that the fuel discharging port 2322 and the fuel return part 2331 are formed to be concentric with the central axes of the upper casing 2320 and the lower casing 2330, respectively, and with the central axis of the cylindrical filtering sheet 2310. Therefore, all the fuel fed into the in-tank filter 2300 through the fuel inlet part 2321 can be discharged after having been filtered when passing through the filtering sheet 2310, so that the fuel pump module 1000 has improved filtering performance.

Hereinbelow, the assembly of the in-tank filter 2300 with the fuel pump 2200 will be described with reference to FIGS. 7 and 8. The fuel feeding port 2201 protrudes upwards from the upper end of the fuel pump 2200 and the fuel inlet part 2321 is formed on the outer circumferential surface of the in-tank filter 2300 in such a way that the fuel feeding port 2201 can be inserted upwards into the fuel inlet part 2321.

Here, both the fuel inlet part 2321 and the fuel feeding port 2201 form a flow line, through which the fuel can flow from the fuel pump 2200 to the in-tank filter 2300, so that a sealing member 2500 may be provided in the junction between the fuel inlet part 2321 and the fuel feeding port 2201 for sealing the junction. In the present invention, the sealing member 2500 may comprise a plurality of sealing members.

After the fuel pump 2200 has been completely assembled with the in-tank filter 2300, the assembly of the fuel pump 2200 and the in-tank filter 2300 are held by the pump retainer 2400. The pump retainer 2400 is provided with a first seat 2410 and a second seat 2420 for seating the in-tank filter 2300 and the fuel pump 2200 therein, respectively.

Here, it is required for the in-tank filter 2300 to be securely held in the first seat 2410. To realize the secure holding of the in-tank filter 2300 in the first seat 2410, the fuel pump module 10000 of the present invention is configured such that the first locking protrusion 2323 protrudes on the outer circumferential surface of the upper casing 2320 of the in-tank filter 2300 and the first locking hole 2411 is formed in the first seat 2410 for catching the first locking protrusion 2323, thus securely holding the in-tank filter 2300 in the pump retainer 2400.

Here, it is preferred that the thickness of the first locking protrusion 2323 become thinner in an upward direction to be gradually reduced in the upward direction. This gradual reduction in thickness allows the in-tank filter 2300 to easily move upwards in the pump retainer 2400 but restricts downward movement thereof in the pump retainer 2400. Thereby, the in-tank filter 2300 can be easily inserted upwards into the pump retainer 2400.

Further, in the fuel pump module 10000 of the present invention, in order to allow the in-tank filter 2300 to be easily inserted into the pump retainer 2400, a guide rail 2324 may be axially formed on the outer circumferential surface of the upper casing 2320 of the in-tank filter 2300 and a guide flange 2412 having a shape corresponding to that of the guide rail 2324 may be formed on the inner circumferential surface of the first seat 2410 of the pump retainer 2400 such that the guide flange 2412 can guide axial movement of the guide rail 2324.

In other words, in the fuel pump module 10000 of the present invention, the in-tank filter 2300 can stably move upwards in the first seat 2410 of the pump retainer 2400 by being guided both by the guide rail 2324 and by the guide flange 2412 and, when the in-tank filter 2300 reaches a designated position, the first locking protrusion 2323 of the in-tank filter 2300 can be caught by the first locking hole 2411 of the first seat 2410, thus improving work efficiency while seating the in-tank filter 2300 in the first seat 2410 of the pump retainer 2400.

Here, the fuel pump 2200 was already assembled with the in-tank filter 2300 by locking the fuel feeding port 2201 to the fuel inlet part 2321 before the fuel pump 2200 is assembled with the pump retainer 2400, so that the fuel pump 2200 can be naturally seated in the second seat 2420 of the pump retainer 2400 at the time the in-tank filter 2300 is seated in the first seat 2410 of the pump retainer 2400.

Further, in the fuel pump module 10000 of the present invention, the primary filter assembly 2600 is tightened to the pump retainer 2400 at a location below the fuel pump 2200, thus more securely holding the fuel pump 2200 in the pump retainer 2400 and further improving the filtering performance of the fuel pump module 1000.

The primary filter assembly 2600 has a shape surrounding the lower part of the fuel pump 2200 and includes a primary filter 2610 for filtering the primarily sucked fuel and a filter holding unit 2620 for holding the primary filter 2610.

During a process of assembling the fuel pump module 1000 of the present invention, the fuel pump 2200 is assembled with the in-tank filter 2300 by locking the fuel feeding port 2201 to the fuel inlet part 2321 by fitting, and then the assembly of the fuel pump 2200 and the in-tank filter 2300 is seated in respective locations in the pump retainer 2400 and, thereafter, the primary filter assembly 2600 is tightened to the pump retainer 2400, thus more securely holding the fuel pump 2200 in the pump retainer 2400.

In order to more securely hold both the fuel pump 2200 and the primary filter assembly 2600 in the second seat 2420 of the pump retainer 2400, a second locking protrusion 2421 protrudes from the outer circumferential surface of the second seat 2420 and a second locking hole 2621 is formed in the filter holding unit 2620 of the primary filter assembly 2600 for catching the second locking protrusion 2421, so that the primary filter assembly 2600 can be securely locked in the pump retainer 2400. As a result, by securing the second locking protrusion 2421 of the second seat 2420 within the second locking hole 2621 of the filter holding unit 2620, the filter holding unit 2620 is tightened to the bottom of the second seat 2420 at a location below the fuel pump 2200.

Here, it is preferred that the second seat 2420 of the pump retainer 2400 be configured to surround the outer circumferential surface of the fuel pump 2200 and thereby to stably hold the fuel pump 2200 therein.

Further, it is preferred that the second locking protrusion 2421 formed on the outer circumferential surface of the second seat 2420 become thinner in a downward direction to gradually reduce in the thickness thereof in the downward direction so that the primary filter assembly 2600 can easily move upwards in the second seat 2420 of the pump retainer 2400 but downward movement thereof in the second seat 2420 is restricted.

When the in-tank filter 2300 and the fuel pump 2200 of the fuel pump module 10000 of the present invention are seated in the first and second seats 2410 and 2420 of the pump retainer 2400, the locking force between them can be increased both by the upward slope of the first locking protrusion 2323 and by the downward slope of the second locking protrusion 2421 which can compensate each other.

Figure 9:
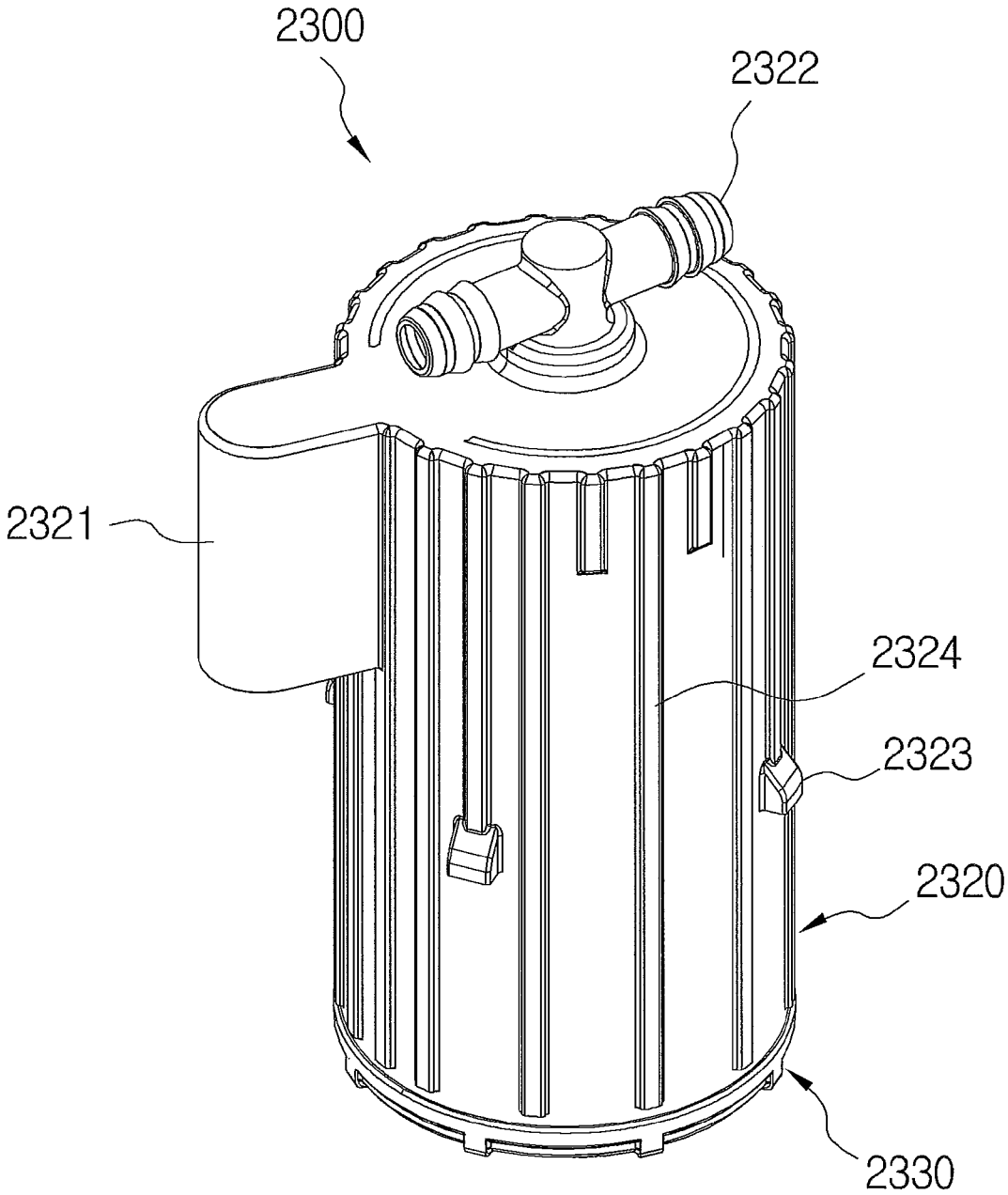
FIG. 9 is a view illustrating an in-tank filter of the fuel pump module according to another embodiment of the present invention.

FIG. 9 is a view illustrating an in-tank filter 2300 of the fuel pump module 10000 according to another embodiment of the present invention. As shown in FIG. 9, the fuel discharging port 2322 of the fuel pump module 10000 may branch in opposite directions.

The fuel discharging port 2322 is connected to the fuel outlet port 1100 of the flange assembly 1000 by the connection hose 4000 and discharges the fuel to the fuel outlet port 1100. When it is intended to connect the fuel discharging port 2322 to the connection hose 4000 after the flange assembly 1000 has been already assembled with the reservoir body assembly 2000 by the guide rods 3000, it may be difficult to connect the connection hose 4000 to the fuel discharging port 2322 due to the obstruction of an element or due to a relative position between the flange assembly 1000 and the reservoir body assembly 2000. In order to solve the above-mentioned problem, the fuel discharging port 2322 of the fuel pump module 10000 according to the present invention may branch in opposite directions, in which the connection hose 4000 may be connected to any one end of the branched fuel discharging port 2322 while the other end of the branched port 2322 is closed.

Figure 10A:
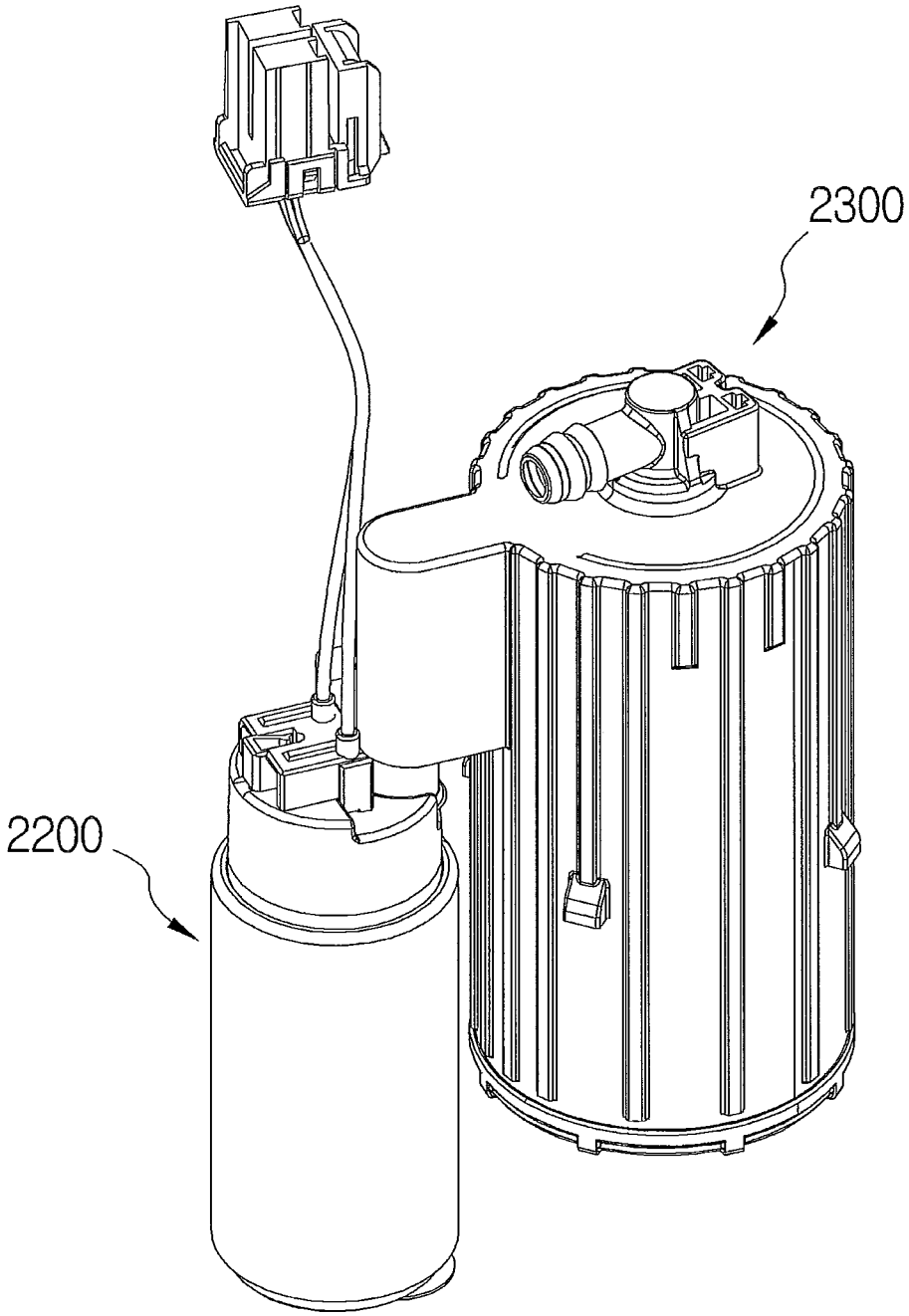
FIGS. 10A through 10D are views illustrating a process of assembling a reservoir body assembly of the fuel pump module according to the present invention.

FIGS. 10A through 10D are views illustrating the process of assembling the reservoir body assembly 2000 of the fuel pump module 10000 according to the present invention. As shown in FIGS. 10A through 10D, to assemble the fuel pump module 10000 of the present invention, respective elements of the module 10000 are primarily produced. Thereafter, the fuel feeding port 2201 of the fuel pump 2200 is inserted into the fuel inlet part 2321 of the in-tank filter 2300, thus assembling the fuel pump 2200 with the in-tank filter 2300, as shown in FIG. 10A.

Figure 10B:
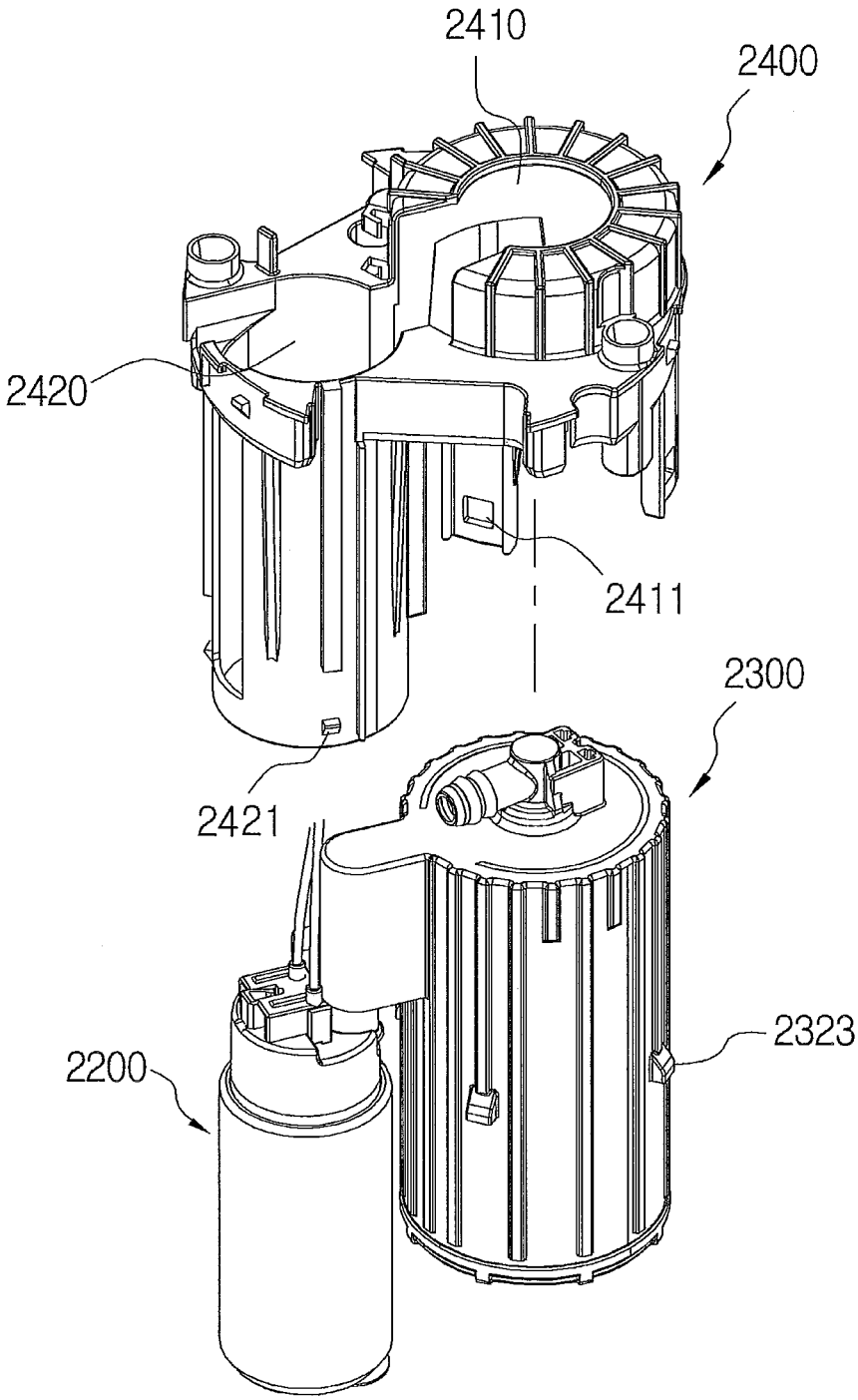
Figure 10C:
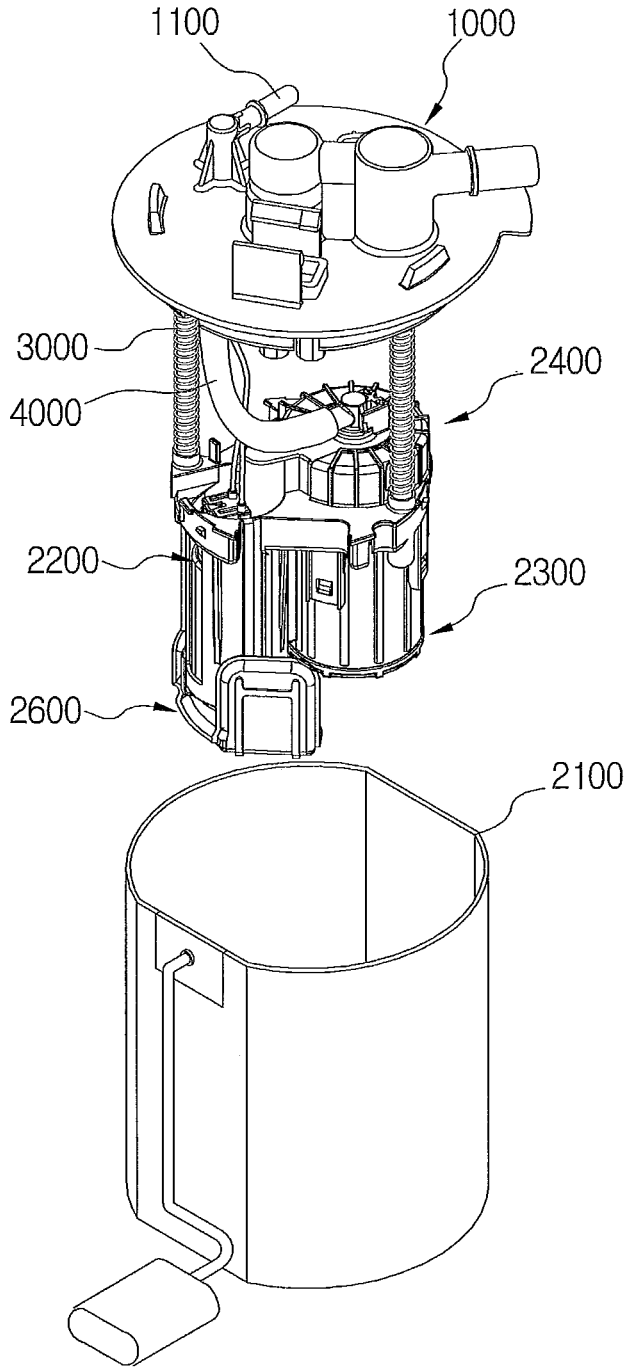

Thereafter, the assembly of the fuel pump 2200 and the in-tank filter 2300 provided by the operation of FIG. 10A is assembled with the pump retainer 2400 by seating the in-tank filter 2300 in the first seat 2410 of the pump retainer 2400, as shown in FIG. 10B.

In the above state, the first locking protrusion 2323 of the in-tank filter 2300 is locked to the first locking hole 2411 of the first seat 2410.

Thereafter, as shown in FIG. 100, the primary filter assembly 2600 is tightened to the assembly provided by operation of FIG. 10B, thus more securely holding the fuel pump 2200 in the pump retainer 2400.

Figure 10D:
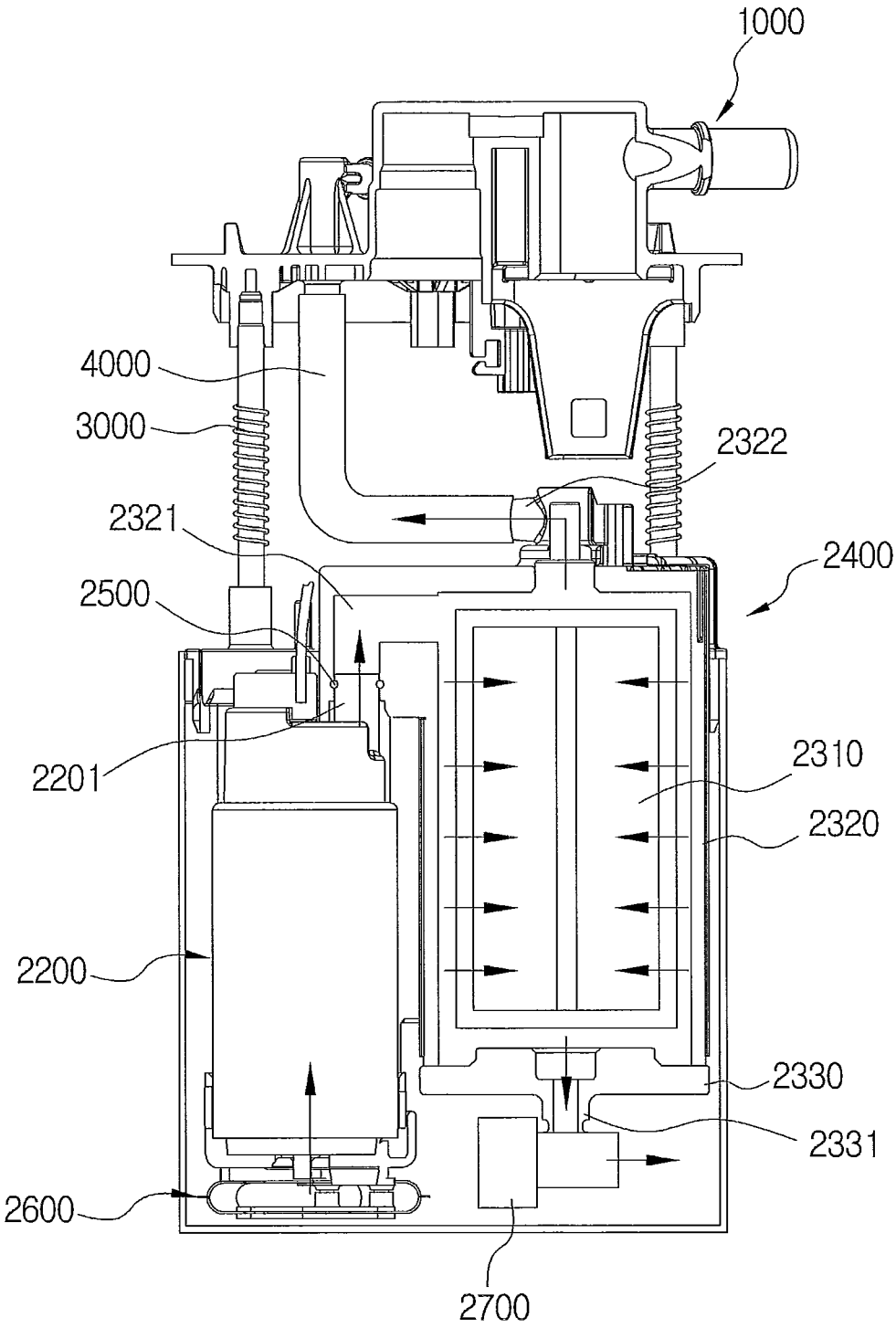

After finishing the operation shown in FIG. 100, the assembly of the in-tank filter 2300, the in-tank filter 2300, the pump retainer 2400 and the primary filter assembly 2600 is inserted into the reservoir casing 2100, as shown in the FIG. 10D, thus bringing the pump retainer 2400 into contact with the reservoir casing 2100 and thereby producing the reservoir body assembly 2000.

Figure 11:
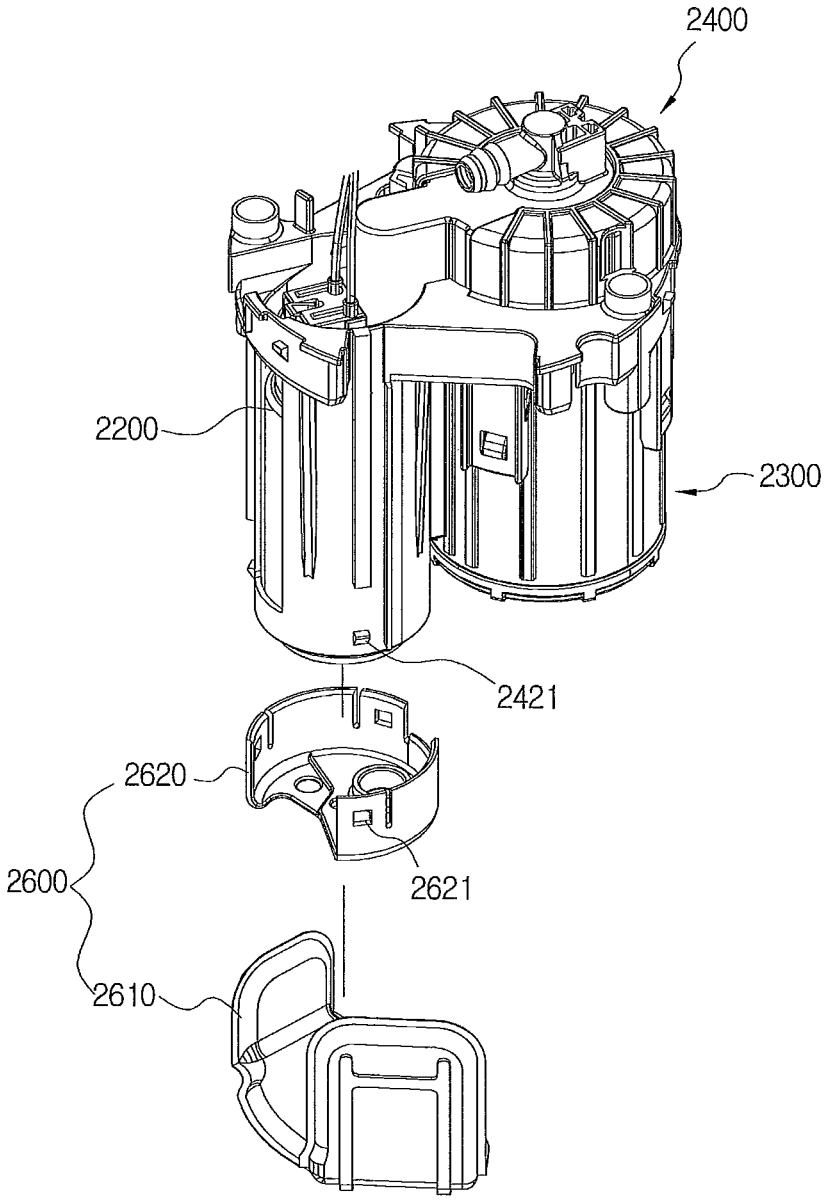
FIG. 11 is a view illustrating the fuel flow in the fuel pump module according to the present invention.

FIG. 11 is a view illustrating the fuel flow in fuel pump module 10000 according to the present invention.

In the fuel pump module 10000 of the present invention, the fuel pumped by the fuel pump 2200 flows into the in-tank filter 2300 sequentially through the fuel feeding port 2201 and the fuel inlet part 2321 and then passes inwardly through the filtering sheet 2310, thereby being filtered. Thereafter, part of the filtered fuel is supplied to the internal combustion engine sequentially through the fuel discharging port 2322, the connection hose 4000, the fuel outlet port 1100 and the fuel supply line. The remaining fuel is discharged to the outside of the in-tank filter 2300 through the fuel return part 2331.

Here, the system pressure of the engine can be regulated by a pressure regulator 2700.

As described above, the fuel pump module 10000 of the present invention can allow the fuel to easily flow therethrough and can realize smallness and improved filtering performance.

In addition to the above-mentioned method of assembling the fuel pump module 10000 of the present invention, in which the in-tank filter 2300, the fuel pump 2200 and the pump retainer 2400 are sequentially assembled with each other, a variety of methods may be used for assembling the fuel pump module 10000 of the present invention.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A fuel pump module, comprising:

a flange assembly mounted to a fuel tank and having a fuel outlet port for supplying fuel to an internal combustion engine;

a reservoir body assembly connected to the flange assembly at a location below the flange assembly, the reservoir body assembly including: a reservoir casing; a fuel pump installed in the reservoir casing and pumping the fuel into the reservoir casing and provided at a predetermined location with a fuel feeding port for feeding the pumped fuel; an in-tank filter including a fuel inlet part connected to the fuel feeding port of the fuel pump, a filtering sheet for filtering the fuel fed from the fuel pump, and a fuel discharging port connected to the fuel outlet port of the flange assembly by a connection hose and supplying the filtered fuel to the flange assembly; and a pump retainer for holding both the fuel pump and the in-tank filter and closing an upper end of the reservoir casing, wherein the in-tank filter comprises an upper casing having an open lower end and receiving the filtering sheet therein, with the fuel inlet part being formed on a predetermined position of an outer circumferential surface of the upper casing and being connected to the fuel feeding port of the fuel pump and with the fuel discharging port being formed on an upper end of the upper casing; and a lower casing closing the open lower end of the upper casing, wherein the fuel pump is directly connected to the in-tank filter, and the fuel inlet part protrudes from the predetermined position of the upper casing in such a way that the fuel feeding port of the fuel pump can be inserted upwards into the fuel inlet part, wherein the pump retainer is provided with a first seat and a second seat for seating the in-tank filter and the fuel pump therein, respectively, further comprising: a primary filter assembly provided at a location outside the fuel pump, the primary filter assembly comprising a primary filter for filtering primarily sucked fuel and a filter holding unit for holding the primary filter, wherein the second seat of the pump retainer is configured to surround an outer circumferential surface of the fuel pump, wherein the filter holding unit is tightened to the bottom of the second seat at a location below the fuel pump;

wherein the in-tank filter is provided on the lower casing with a fuel return part for discharging the filtered fuel into the reservoir casing; and wherein in the in-tank filter, the filtering sheet is folded several times to form a folded cylindrical shape, and both the fuel discharging port and the fuel return part are concentric with a central axis of the in-tank filter so as to communicate with an interior of the cylindrical filtering sheet.

2. The fuel pump module as set forth in claim 1, further comprising:

a sealing member provided in a junction between the fuel inlet part of the in-tank filter and the fuel feeding port of the fuel pump.

3. The fuel pump module as set forth in claim 1, wherein the fuel discharging port of the in-tank filter branches in opposite directions.

4. The fuel pump module as set forth in claim 1, wherein the in-tank filter is provided with a first locking protrusion protruding on an outer circumferential surface of an upper casing of the in-tank filter in such a way that thickness of the first locking protrusion becomes thinner in an upward direction so as to be gradually reduced in the upward direction, and the pump retainer is provided with a first locking hole formed in the first seat for catching the first locking protrusion, thus holding the in-tank filter in the pump retainer.

5. The fuel pump module as set forth in claim 4, wherein the in-tank filter is provided with a guide rail axially formed on the outer circumferential surface of the upper casing, and the pump retainer is provided with a guide flange having a shape corresponding to that of the guide rail and being formed on an inner circumferential surface of the first seat, and guiding axial movement of the guide rail in the first seat.

6. The fuel pump module as set forth in claim 1, wherein the second seat of the pump retainer has a second locking protrusion protruding from an outer circumferential surface of the second seat in such a way that the second locking protrusion becomes thinner in a downward direction so as to gradually reduce in thickness thereof in the downward direction, and with a second locking hole formed in the filter holding unit of the primary filter assembly for catching the second locking protrusion, so that the primary filter assembly can be locked in the pump retainer.

* * * * *